US008547314B2

(12) United States Patent
Shih et al.

(10) Patent No.: US 8,547,314 B2
(45) Date of Patent: Oct. 1, 2013

(54) LIQUID CRYSTAL DISPLAY WITH WHITE CORRECTION OF A BACKLIGHT AND DRIVING METHOD THEREOF

(75) Inventors: An Shih, Miao-Li Country (TW); Shun-Ming Huang, Shenzhen (CN); Dao-Peng Xie, Shenzhen (CN)

(73) Assignees: Innocom Technology (Shenzhen) Co., Ltd., Shenzhen, Guangdong Province (CN); Chimei InnoLux Corporation, Miaoli County (TW)

( * ) Notice: Subject to any disclaimer, the term of this patent is extended or adjusted under 35 U.S.C. 154(b) by 420 days.

(21) Appl. No.: 12/765,883

(22) Filed: Apr. 23, 2010

(65) Prior Publication Data

US 2011/0084988 A1 Apr. 14, 2011

(51) Int. Cl.
*G09G 3/36* (2006.01)
*G09G 5/10* (2006.01)

(52) U.S. Cl.
USPC ..... 345/89; 345/690

(58) Field of Classification Search
USPC ..... 345/590, 89, 690
See application file for complete search history.

(56) References Cited

U.S. PATENT DOCUMENTS 5,600,764 A * 2/1997 Kakutani ..... 345/591
2007/0052662 A1 3/2007 Kim et al.
2010/0091032 A1* 4/2010 Ueki et al. ..... 345/590
2010/0123739 A1* 5/2010 Kim et al. ..... 345/690
2011/0063330 A1* 3/2011 Bae et al. ..... 345/690

FOREIGN PATENT DOCUMENTS

CN 100526945 A 8/2009
JP P2007-1104323 A 4/2007
WO WO/2008/038568 * 4/2008

OTHER PUBLICATIONS

L. Mitas, H. Mitasova, Geographical Information Systems: Principles, Techniques, Management and Applications (1999), pp. 481-492.*

Lam, N. S., Spatial Interpolation Methods Review, The American Cartographer 10: 129-149, 1983.*

* cited by examiner

*Primary Examiner* — Chanh Nguyen
*Assistant Examiner* — John Kirkpatrick
(74) *Attorney, Agent, or Firm* — Li & Cai Intellectual Property (USA) Office

(57) ABSTRACT

A liquid crystal display includes a liquid crystal panel, a gray scale correction circuit, a control circuit, and a data driver. The gray scale correction circuit provides a corrected red, green, blue (RGB) data set corresponding to a white image element. The control circuit receives an original RGB data set, and selectively outputs one of the original RGB data set and a corrected RGB data set according to a gray scale value of the of the original data set. The data driver provides a gray scale voltage to the liquid crystal panel according to the output RGB data set of the control circuit.

15 Claims, 5 Drawing Sheets

LIQUID CRYSTAL DISPLAY WITH WHITE CORRECTION OF A BACKLIGHT AND DRIVING METHOD THEREOF

BACKGROUND

1. Technical Field

The present disclosure relates to liquid crystal display technology, and more particularly, to a liquid crystal display (LCD) and a method for driving the LCD.

2. Description of Related Art

LCDs have the advantages of portability, low power consumption, and low radiation, and thus have been widely used in various portable information products. A typical LCD generally includes a liquid crystal panel, and a backlight module configured for providing uniform plane light for illuminating the liquid crystal panel.

Light emitting diodes (LEDs) are widely used as illuminators of the backlight module. A frequently used LED includes a chip and a sealant having phosphor particles therein. The chip emits blue light, and stimulates the phosphor particles to emit yellow light, such that the emitted blue light is mixed with the yellow light and thereby generating white light.

Because the white light emitted by the LED is mixed by the yellow light and the blue light, due to manufacturing limitations, the white light provided by the LED may have color casts, appearing bluish or yellowish. When such LEDs are adopted in the backlight module of the LCD, image quality of the LCD is adversely affected.

What is needed, therefore, is an LCD that can overcome the described limitations, what is also needed is a method for driving the LCD.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe specific exemplary embodiments of the present disclosure in detail.

Figure 1:
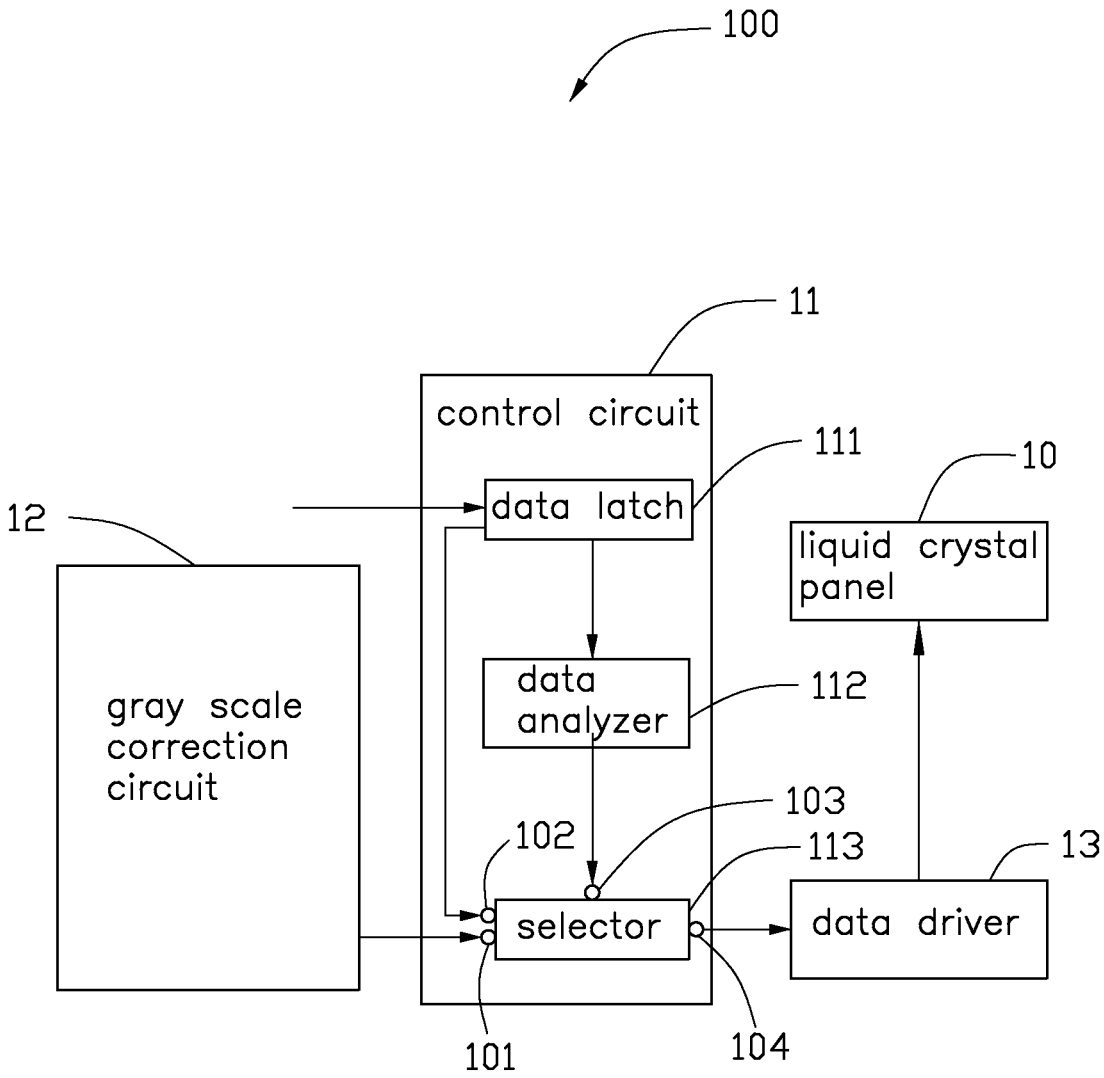
FIG. 1 is a block diagram of an LCD according to an embodiment of the present disclosure, the display apparatus including a gray scale correction circuit.

Referring to FIG. 1, an LCD 100 according to a first embodiment of the present disclosure is shown. The LCD 100 includes a liquid crystal panel 10, a control circuit 11, a gray scale correction circuit 12, and a data driver 13.

The liquid crystal panel 10 is configured to receive gray scale voltages from the data driver 13, and display images according to the gray scale voltages. In particular, the displayed image can be divided into a plurality of image elements. The liquid crystal panel 10 may include a plurality of pixel units arranged in a matrix, and each of the pixel units is configured to display a respective image element. In one embodiment, each of the pixel unit may include a red (R) sub-pixel, a green (G) sub-pixel, and a blue (B) sub-pixel.

The control circuit 11 includes a data latch 111, a data analyzer 112, and a selector 113. The data latch 111 receives and latches original red, green, blue (RGB) data sets corresponding to an image to be displayed in a subsequent frame period. The original RGB data sets can be provided by a video source such as a host computer, a disk player, for example, and be transmitted to the data latch 111 via an interface circuit (not shown). Each of the original RGB data sets corresponds to an image element to be displayed in a related pixel unit. Specifically, each original RGB data set may include a red data signal, a green data signal, and a blue data signal corresponding to the red sub-pixel, the green sub-pixel, and the blue sub-pixel of the pixel unit, respectively.

The data analyzer 112 is electrically coupled to the data latch 111, and reads the original RGB data signal set from the data latch 111 in a certain driving timing, analyzes a gray scale value corresponding to the original RGB data signal set, and compares the analyzed gray scale value with a predetermined gray scale value, thereby generating a control signal according to a comparison result. Because the original RGB data set includes the red data signal, the green data signal, and the blue data signal, the gray scale value thereof correspondingly has three sub-values, which can be written as (Xr, Xg, Xb). Similarly, the predetermined gray scale value also has three sub-values, and can be written as (Yr, Yg, Yb).

In one embodiment, when the analyzed gray scale value (Xr, Xg, Xb) is substantially the same as the predetermined gray scale value (Yr, Yg, Yb) based on the comparison result, the control signal generated by the data analyzer 112 may have a first value; otherwise, the control signal generated by the data analyzer 112 may have a second value.

For example, the predetermined gray scale value (Yr, Yg, Yb) may correspond to a white image element. In this circumstance, the predetermined gray scale value (Yr, Yg, Yb) would be (255, 255, 255). That is, when each sub-value Xr, Xg, Xb of the analyzed gray scale value is substantially equal to 255, it is determined that a preset condition has been met, and the generated control signal has the first value.

The selector 113 may be a multiplexer, which includes a first data input terminal 101 electrically coupled to the gray scale correction circuit 12, a second data input terminal 102 electrically coupled to the data latch 111, a control terminal 103 electrically coupled to the data analyzer 112, and a data output terminal 104 electrically coupled to the data driver 13. The selector 113 receives an original RGB data set and a corrected RGB data set and selectively outputs one thereof via the output terminal 104 according to the control signal received from the data analyzer 112 via the control terminal 103. For example, when the control signal has the first value, the selector 113 reads the corrected RGB data set from the gray scale correction circuit 12 via the first data input 101 thereof, and then outputs the corrected RGB data set to the data driver 13. When the control signal has the second value, the selector 113 reads the original RGB data set from the data latch 111 via the second data input 102, and then outputs the original RGB data set to the data driver 13.

The data driver 13 is configured to receive the output RGB data set of the control circuit 11, generate corresponding gray scale voltages according to the received RGB data set, and output the gray scale voltages to the liquid crystal panel 10, so as to drive the liquid crystal panel to display a corresponding image.

The gray scale correction circuit 12 provides a corrected RGB data set corresponding to a predetermined image element. The predetermined image element may be a white image element, from a cooperation of the red sub-pixel, the green sub-pixel, and the blue sub-pixel of the pixel unit receiving the corrected RGB data set. Specifically, the corrected RGB data set may be pre-stored in the gray scale correction 12, and output to the selector 113 when it is selected by the selector 113.

Figure 2:
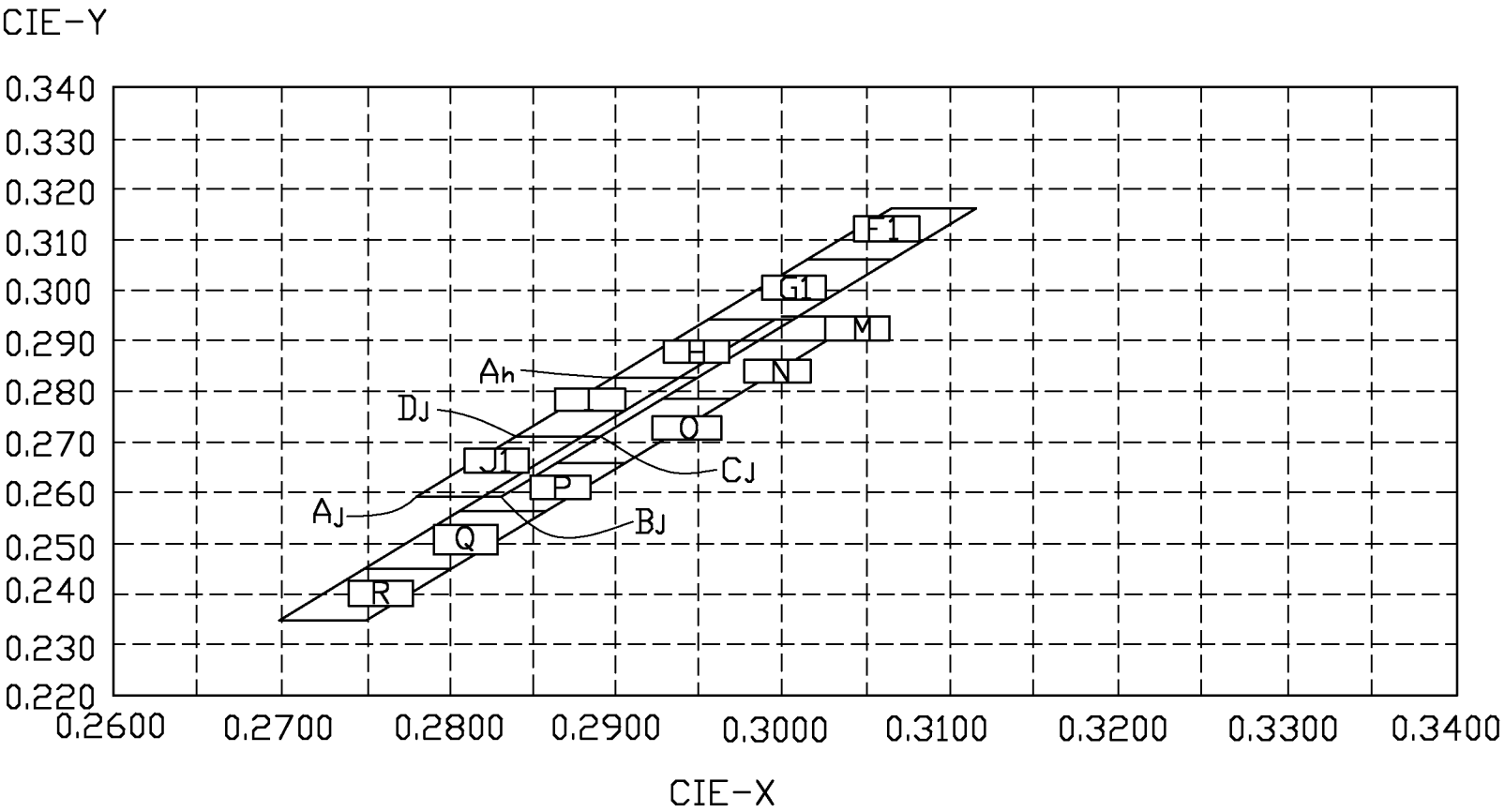
FIG. 2 is a schematic diagram of a chroma coordinate.

In the present disclosure, two exemplary structures for the gray scale correction circuit 12 are provided. To simplify description, light emitting diodes (LEDs) as light sources for the liquid crystal panel 10 of the LCD 100 are used as an example. Additionally, a chroma coordinate is also defined herein. Referring to FIG. 2, a schematic diagram of a chroma coordinate of the light source is shown. Generally, the chroma coordinate can be divided into a plurality of chroma regions, which can be labeled with F1, G1, H, J1, M, N, O, P, Q, and R. Each of the chroma regions has a shape of an approximate parallelogram, and includes four boundary coordinate values corresponding to the endpoints of the parallelogram. For example, the four boundary coordinate values of the chroma region J1 can be Aj(Xaj, Yaj), Bj(Xbj, Ybj), Cj(Xcj, Ycj), and Dj(Xdj, Ydj).

Figure 3:
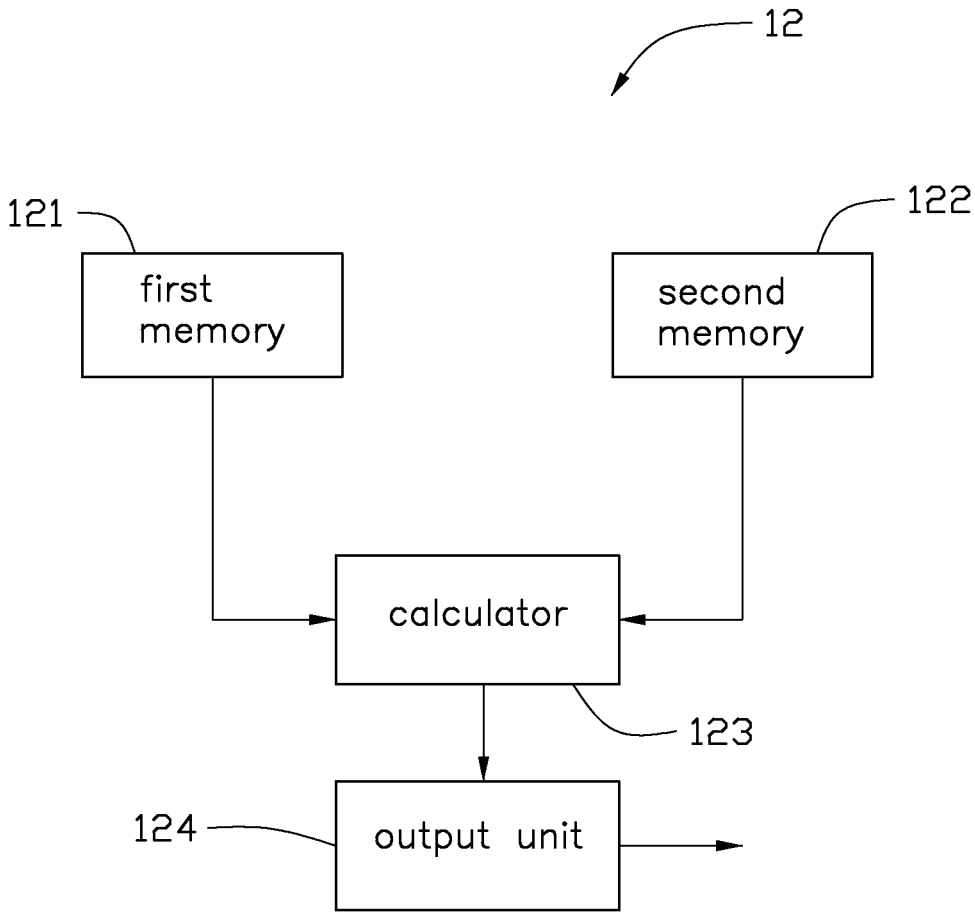
FIG. 3 is a block diagram of an exemplary gray scale correction circuit of the LCD of FIG. 1.

Referring also to FIG. 3, in one embodiment, the gray scale correction circuit 12 may include a first memory 121, a second memory 122, a calculator 123, and an output unit 124.

The first memory 121 provides an actual chroma coordinate value (X0, Y0) corresponding to a full-white image displayed in the LCD 100. The full-white image indicates that all the image elements displayed by the pixel units are white image elements. The actual chroma coordinate value (X0, Y0) can be obtained by a test process and stored into the first memory 121 during manufacture of the LCD 100. Normally, the actual chroma coordinate value (X0, Y0) is correlative to the light sources employed in the LCD 100. In actual operation, it is preferred that the actual chroma coordinate value (X0, Y0) be within a predetermined chroma region, however, due to the manufacturing limitations of the light sources, the actual chroma coordinate value (X0, Y0) may be within other chroma regions.

The second memory 122 stores boundary coordinate values of each chroma region, and a preset gray scale correction value of each boundary coordinate value. Each preset gray scale correction value includes a red gray scale correction value, a green gray scale correction value, and a blue gray scale correction value. In particular, the preset gray scale correction value can be obtained through a testing processing.

The calculator 123 determines which chroma region the actual chroma coordinate value (X0, Y0) is within according to the boundary coordinate values of the chroma regions, and performs a preset calculation based on the boundary coordinate values of the determined chroma region and the corresponding preset gray scale correction values, so as to provide a corrected gray scale value for a white image element. For example, the preset calculation can be expressed as:

$$R = \frac{\frac{1}{r1} * R1 + \frac{1}{r2} * R2 + \frac{1}{r3} * R3 + \frac{1}{r4} * R4}{\frac{1}{r1} + \frac{1}{r2} + \frac{1}{r3} + \frac{1}{r4}}$$

$$G = \frac{\frac{1}{r1} * G1 + \frac{1}{r2} * G2 + \frac{1}{r3} * G3 + \frac{1}{r4} * G4}{\frac{1}{r1} + \frac{1}{r2} + \frac{1}{r3} + \frac{1}{r4}}$$

-continued $$B = \frac{\frac{1}{r1} * B1 + \frac{1}{r2} * B2 + \frac{1}{r3} * B3 + \frac{1}{r4} * B4}{\frac{1}{r1} + \frac{1}{r2} + \frac{1}{r3} + \frac{1}{r4}}$$

In an alternative embodiment, the preset calculation can be expressed as:

$$R = \frac{\frac{1}{r1} * R1 + \frac{1}{r2} * R2 + \frac{1}{r3} * R3 + \frac{1}{r4} * R4}{\frac{1}{r1} + \frac{1}{r2} + \frac{1}{r3} + \frac{1}{r4}}$$

$$G = 255$$

$$B = \frac{\frac{1}{r1} * B1 + \frac{1}{r2} * B2 + \frac{1}{r3} * B3 + \frac{1}{r4} * B4}{\frac{1}{r1} + \frac{1}{r2} + \frac{1}{r3} + \frac{1}{r4}}$$

In the above formulae, R, G, and B respectively represent corrected gray scale values for a red sub-pixel, a green sub-pixel, and a blue sub-pixel. Moreover, R1-R4, G1-G4, B1-B4 respectively represent the red gray scale correction values, the green gray scale correction values, and the blue gray scale correction values corresponding to the four boundary coordinate values of the determined chroma region, and r1-r4 respectively represent a distance between the actual chroma coordinate value (X0, Y0) and each of the boundary coordinate values of the determined chroma region.

The output unit 124 provides a corrected RGB data set according to the corrected gray scale values calculated by the calculator 123, and outputs the corrected RGB data set to the control circuit 11 when the selector 113 selects the corrected RGB data set as an output of the control circuit 11.

Figure 4:
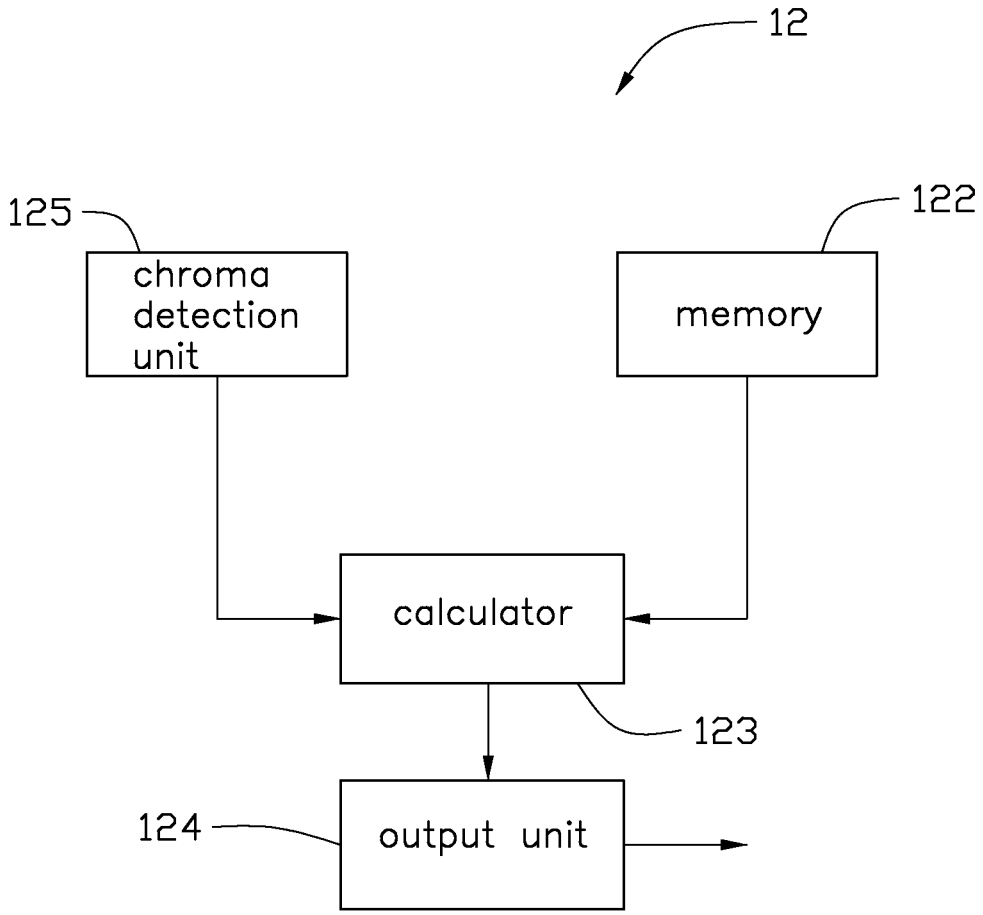
FIG. 4 is a block diagram of another exemplary gray scale correction circuit of the LCD of FIG. 1.

Referring to FIG. 4, in an alternative embodiment, the first memory 121 of the gray scale correction circuit 12 may be substituted with a chroma detection unit 125. The chroma detection unit 125 obtains an up-to-date actual chroma coordinate value corresponding to a full-white image by real-time testing of images displayed by the LCD 100. It is noted that the actual chroma coordinate value may shift when the LCD 100 is aged, thus, by real-time testing the actual chroma coordinate value, and correspondingly updates the pre-stored corrected RGB data set, the corrected RGB data set replacing the original RGB data set is more reliable.

In summary, the LCD 100 employs the control circuit 11 to determine whether the received original RGB data set corresponds to a white image element, and, if so, the original RGB data set is replaced with a corrected RGB data set. By use of the corrected RGB data set, a color shift which may otherwise exist is compensated, and thus display quality of the LCD 100 is improved.

Figure 5:
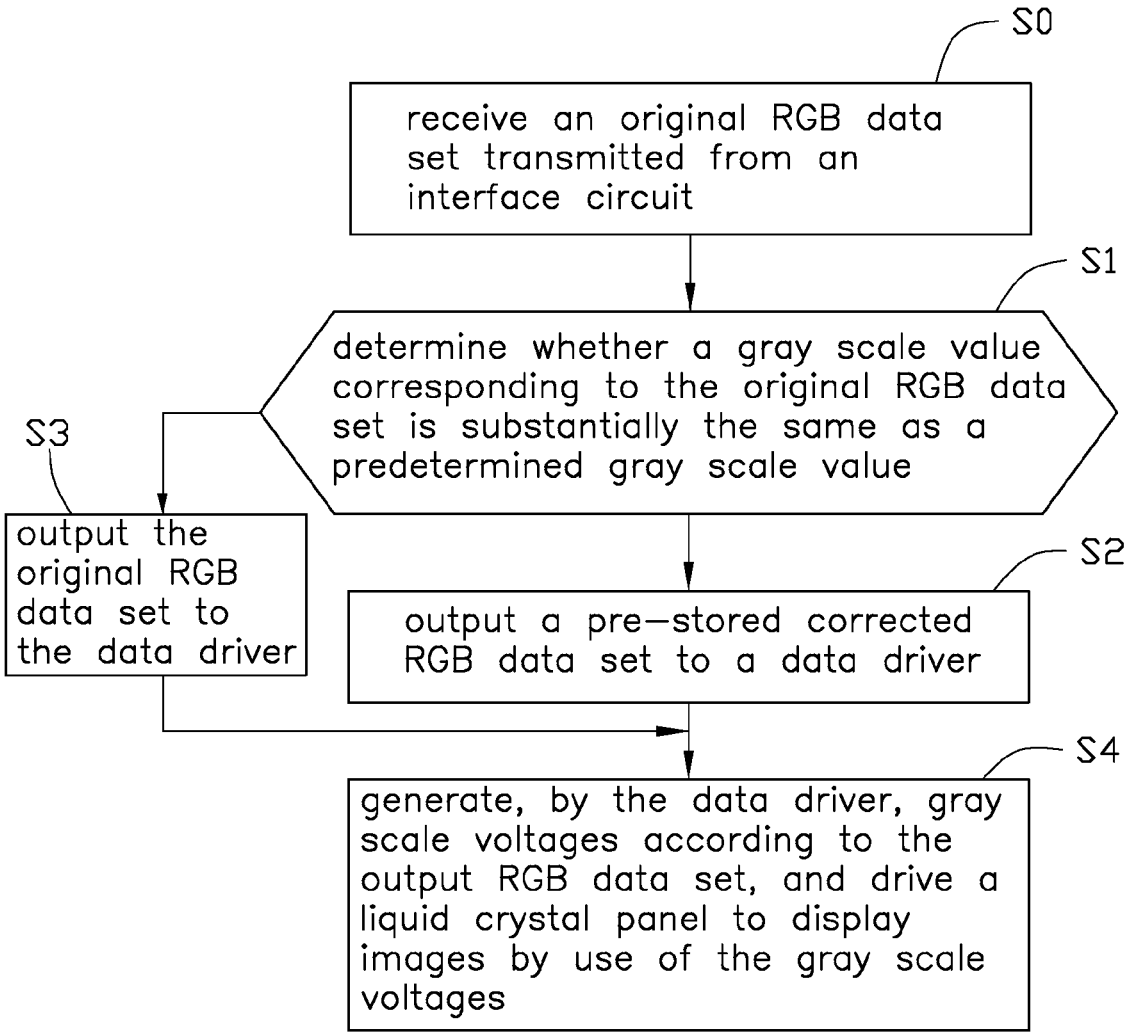
FIG. 5 is a flowchart of a method for driving an LCD according to another embodiment of the present disclosure.

A method for driving an LCD is provided, as implemented, for example, in an LCD, such as, for example, that of FIG. 1. Referring to FIG. 5, the method may include, in step S0, receiving an original RGB data set transmitted from an interface circuit. In step S1, it is determined whether a gray scale value corresponding to the original RGB data set is substantially the same as a predetermined gray scale value. If so, step S2 is implemented. If not, step S3 is implemented. In step S2, a pre-stored corrected RGB data set is output to a data driver. In step S3, the original RGB data set is output to the data driver. In step S4, gray scale voltages according to the output RGB data set are generated by the data driver and a liquid crystal panel is driven to display images using the gray scale voltages.

It is to be further understood that even though numerous characteristics and advantages of a preferred embodiment have been set out in the foregoing description, together with details of the structures and functions of the embodiments, the disclosure is illustrative only; and that changes may be made in detail, especially in matters of shape, size and arrangement of parts within the principles of present disclosure to the full extent indicated by the broad general meaning of the terms in which the appended claims are expressed.

What is claimed is:

1. A liquid crystal display, comprising:

a liquid crystal panel configured for displaying an image having a plurality of image elements, the liquid crystal panel comprising a plurality of pixel units each corresponding to one of the image elements;

a gray scale correction circuit, comprising:

a calculator configured to perform a predetermined calculation on an actual chroma coordinate value of a full-white image of the liquid crystal panel, boundary coordinate values of a chroma region in which the actual chroma coordinate value is located, and preset gray scale correction values of the boundary coordinate values to provide a corrected gray scale value; and an output unit configured to provide a corrected red, green, blue (RGB) data set according to the corrected gray scale value; and a control circuit, comprising:

a data analyzer, configured for analyzing a gray scale value of the original RGB data signal set, comparing the analyzed gray scale value with a predetermined gray scale value, and thereby generating a control signal according to a comparison result; and a selector, configured to select one of the original RGB data set and the corrected RGB data set as the output RGB data set of the control circuit according to the control signal; and a data driver configured for providing a gray scale voltage to the liquid crystal panel according to the an output RGB data set of the control circuit.

2. The liquid crystal display of claim 1, wherein when the analyzed gray scale value is substantially equal to the predetermined gray scale value, the control signal acquires a first value; otherwise, the control signal acquires a second value.

3. The liquid crystal display of claim 2, wherein when the control signal has the first value, the selector selects and outputs the corrected RGB data set to the data driver, and when the control signal has the second value, the selector selects and outputs the original RGB data set to the data driver.

4. The liquid crystal display of claim 1, wherein the control circuit further comprises a data latch configured to receive the original RGB data set from an interface circuit, and provide the original RGB data set to the data analyzer in a predetermined driving timing.

5. The liquid crystal display of claim 1, wherein the original data set comprises a red data signal, a green data signal, and a blue data signal respectively corresponding to a red sub-pixel, a green sub-pixel, and a blue sub-pixel of a pixel unit of the liquid crystal panel.

6. The liquid crystal display of claim 1, wherein the predetermined calculation is expressed as:

$$R = \frac{\frac{1}{r1} * R1 + \frac{1}{r2} * R2 + \frac{1}{r3} * R3 + \frac{1}{r4} * R4}{\frac{1}{r1} + \frac{1}{r2} + \frac{1}{r3} + \frac{1}{r4}}$$

$$G = \frac{\frac{1}{r1} * G1 + \frac{1}{r2} * G2 + \frac{1}{r3} * G3 + \frac{1}{r4} * G4}{\frac{1}{r1} + \frac{1}{r2} + \frac{1}{r3} + \frac{1}{r4}}$$

$$B = \frac{\frac{1}{r1} * B1 + \frac{1}{r2} * B2 + \frac{1}{r3} * B3 + \frac{1}{r4} * B4}{\frac{1}{r1} + \frac{1}{r2} + \frac{1}{r3} + \frac{1}{r4}}$$

where R, G, and B respectively represent corrected gray scale values for a red sub-pixel, a green sub-pixel, and a blue sub-pixel of the pixel unit; R1-R4, G1-G4, B1-B4 respectively represent red gray scale correction values, green gray scale correction values, and blue gray scale correction values corresponding to four boundary coordinate values of the chroma region; and r1-r4 respectively represent a distance between the actual chroma coordinate value and each of the boundary coordinate values of the chroma region.

7. The liquid crystal display of claim 6, wherein the gray scale correction circuit further comprises a memory unit configured for storing the actual chroma coordinate value, and the actual chroma coordinate value is obtained through testing processing, and is stored into the memory during manufacture of the liquid crystal display.

8. The liquid crystal display of claim 6, wherein the gray scale correction circuit further comprises a chroma detecting unit configured for detecting an up-to-date actual chroma coordinate value by real-time testing a full-white image displayed by the liquid crystal display.

9. The liquid crystal display of claim 1, wherein the predetermined calculation is expressed as:

$$R = \frac{\frac{1}{r1} * R1 + \frac{1}{r2} * R2 + \frac{1}{r3} * R3 + \frac{1}{r4} * R4}{\frac{1}{r1} + \frac{1}{r2} + \frac{1}{r3} + \frac{1}{r4}}$$

$$G = 255$$

$$B = \frac{\frac{1}{r1} * B1 + \frac{1}{r2} * B2 + \frac{1}{r3} * B3 + \frac{1}{r4} * B4}{\frac{1}{r1} + \frac{1}{r2} + \frac{1}{r3} + \frac{1}{r4}}$$

where R, G, and B respectively represent corrected gray scale values for a red sub-pixel, a green sub-pixel, and a blue sub-pixel of the pixel unit; R1-R4, B1-B4 respectively represent red gray scale correction values and blue gray scale correction values corresponding to four boundary coordinate values of the chroma region; and r1-r4 respectively represent a distance between the actual chroma coordinate value and each of the boundary coordinate values of the chroma region.

10. A method for driving a display, comprising:

receiving an original red, green, blue (RGB) data set;

determining whether a gray scale value of the original RGB data set is substantially equal to a predetermined gray scale value corresponding to an actual chroma coordinate value of a full white image;

outputting the original RGB data set to the data driver when the determined gray scale value is not substantially equal to the predetermined gray scale value;

determining a chroma region in which the actual chroma coordinate value is located;

performing a predetermined calculation on the actual chroma coordinate value, boundary coordinate values of the determined chroma region, and preset gray scale correction values of the boundary coordinate values, and thereby obtaining a corrected gray scale value;

providing a corrected RGB data set based on the actual chroma coordinate value, the boundary coordinate values of the determined chroma region, and the preset gray scale correction values of the boundary coordinate values;

generating an corrected RGB data set according to the corrected gray scale value;

outputting a pre-stored corrected RGB data set when the determined gray scale value is substantially equal to the predetermined gray scale value;

generating gray scale voltages according to the output RGB data set, so as to drive a display panel to display an image.

11. The method of claim 10, wherein the predetermined calculation is expressed as:

$$R = \frac{\frac{1}{r1} * R1 + \frac{1}{r2} * R2 + \frac{1}{r3} * R3 + \frac{1}{r4} * R4}{\frac{1}{r1} + \frac{1}{r2} + \frac{1}{r3} + \frac{1}{r4}}$$

$$G = \frac{\frac{1}{r1} * G1 + \frac{1}{r2} * G2 + \frac{1}{r3} * G3 + \frac{1}{r4} * G4}{\frac{1}{r1} + \frac{1}{r2} + \frac{1}{r3} + \frac{1}{r4}}$$

$$B = \frac{\frac{1}{r1} * B1 + \frac{1}{r2} * B2 + \frac{1}{r3} * B3 + \frac{1}{r4} * B4}{\frac{1}{r1} + \frac{1}{r2} + \frac{1}{r3} + \frac{1}{r4}}$$

where R, G, and B respectively represent corrected gray scale values for a red sub-pixel, a green sub-pixel, and a blue sub-pixel of the pixel unit; R1-R4, G1-G4, B1-B4 respectively represent red gray scale correction values, green gray scale correction values, and blue gray scale correction values corresponding to four boundary coordinate values of the chroma region; and r1-r4 respectively represent a distance between the actual chroma coordinate value and each of the boundary coordinate values of the chroma region.

12. The method of claim 10, wherein the predetermined calculation is expressed as:

$$R = \frac{\frac{1}{r1} * R1 + \frac{1}{r2} * R2 + \frac{1}{r3} * R3 + \frac{1}{r4} * R4}{\frac{1}{r1} + \frac{1}{r2} + \frac{1}{r3} + \frac{1}{r4}}$$

$$G = 255$$

-continued $$B = \frac{\frac{1}{r1} * B1 + \frac{1}{r2} * B2 + \frac{1}{r3} * B3 + \frac{1}{r4} * B4}{\frac{1}{r1} + \frac{1}{r2} + \frac{1}{r3} + \frac{1}{r4}}$$

where R, G, and B respectively represent corrected gray scale values for a red sub-pixel, a green sub-pixel, and a blue sub-pixel of the pixel unit; R1-R4, B1-B4 respectively represent red gray scale correction values and blue gray scale correction values corresponding to four boundary coordinate values of the chroma region; and r1-r4 respectively represent a distance between the actual chroma coordinate value and each of the boundary coordinate values of the chroma region.

13. The method of claim 10, wherein the actual chroma coordinate value is obtained and pre-stored during manufacture of the liquid crystal display.

14. The method of claim 10, wherein the actual chroma coordinate value is detected by real-time testing a full-white image displayed by the liquid crystal display.

15. A liquid crystal display, comprising:

a liquid crystal panel;

a gray scale correction circuit, comprising:

a first memory unit configured for storing an actual chroma coordinate value of a displayed white image;

a second memory unit configured for storing boundary coordinate values of each chroma region in which the actual chroma coordinate value can be located, and preset gray scale correction values of each of the boundary coordinate values comprising red gray scale correction values, green gray scale correction values, and blue gray scale correction values;

a calculator configured for performing predetermined calculations on the boundary coordinate values, the preset gray scale correction values, and the actual chroma coordinate value, thereby obtaining corrected gray scale values; and an output unit configured for providing corrected red, green, blue (RGB) data signals of the white image according to the corrected gray scale values; a control circuit configured for receiving original RGB data signals, comprising:

a data analyzer, configured for determining whether the original RGB data signals correspond to the white image based on gray scale values of the original RGB data signals; and a selector, configured for outputting the corrected RGB data signals when the original RGB data signals correspond to the white image and outputting the original RGB data signals when the original RGB data signals don't correspond to the white image; and a data driver configured for providing gray scale voltages to the liquid crystal panel according to the output RGB data signals of the control circuit.

* * * * *